US009381673B2

(12) United States Patent
Gadd

(10) Patent No.: US 9,381,673 B2
(45) Date of Patent: Jul. 5, 2016

(54) CUTTING APPARATUS HAVING BLADE COVER

(71) Applicant: DISCO CORPORATION, Tokyo (JP)

(72) Inventor: Michael Gadd, Tokyo (JP)

(73) Assignee: Disco Corporation, Tokyo (JP)

( * ) Notice: Subject to any disclaimer, the term of this patent is extended or adjusted under 35 U.S.C. 154(b) by 9 days.

(21) Appl. No.: 14/255,157

(22) Filed: Apr. 17, 2014

(65) Prior Publication Data

US 2014/0311471 A1 Oct. 23, 2014

(30) Foreign Application Priority Data

Apr. 18, 2013 (JP) ..... 2013-087101

(51) Int. Cl.
*B28D 5/00* (2006.01)

(52) U.S. Cl.
CPC ..... *B28D 5/0076* (2013.01)

(58) Field of Classification Search
CPC ..... B28D 5/00; B28D 5/0076; B28D 5/0005; B24B 55/12; B24B 49/12
USPC ..... 451/456, 450, 454; 125/13.01
See application file for complete search history.

(56) References Cited

U.S. PATENT DOCUMENTS

| | | | | |
|---|---|---|---|---|
| 4,558,686 | A * | 12/1985 | Ono | 125/13.01 |
| 5,031,360 | A * | 7/1991 | Farnworth et al. | 451/6 |
| 6,105,567 | A * | 8/2000 | Sun et al. | 125/13.01 |
| 6,216,682 | B1 * | 4/2001 | Nambu et al. | 125/13.01 |
| 6,552,811 | B2 * | 4/2003 | Hayashi | 356/614 |
| 6,857,939 | B2 * | 2/2005 | Adachi et al. | 451/6 |
| 2007/0175466 | A1 * | 8/2007 | Kadoi | B28D 5/0076 125/13.01 |

FOREIGN PATENT DOCUMENTS

JP 2006-231474 9/2006

* cited by examiner

*Primary Examiner* — Robert Rose
(74) *Attorney, Agent, or Firm* — Greer Burns & Crain Ltd.

(57) ABSTRACT

A blade cover covers a cutting blade mounted on a spindle. The blade cover has a bottom portion formed with an opening from which the lower end of the cutting blade projects. A cutting fluid is supplied to the upper surface of a workpiece in the periphery of the opening of the blade cover. A discharge opening is formed in the blade cover. Air is sucked from the discharge opening by a vacuum source. The cutting fluid supplied to the upper surface of the workpiece is taken from the opening into the blade cover in association with the rotation of the cutting blade and thereafter discharged from the discharge opening to the outside of the blade cover. Accordingly, scattering of the cutting fluid can be suppressed.

2 Claims, 8 Drawing Sheets

CUTTING APPARATUS HAVING BLADE COVER

BACKGROUND OF THE INVENTION

1. Field of the Invention

The present invention relates to a cutting apparatus having a cutting blade for cutting a thin platelike workpiece such as a semiconductor wafer and a substrate for various electronic parts, and more particularly to a cutting apparatus having a blade cover for covering the cutting blade.

2. Description of the Related Art

In a precision cutting apparatus such as a dicing apparatus for dividing a workpiece such as a semiconductor wafer into many chips, a cutting blade is mounted on the front end of a spindle adapted to rate at high speeds. By rotating the spindle, the cutting blade is rotated to cut the workpiece.

In this kind of cutting apparatus, a cutting fluid is supplied to the cutting blade during cutting, so as to remove process heat generated due to cutting and also remove cut dust generated in cutting from the upper surface of the workpiece. Particularly in the case that the workpiece is a wafer on which imaging devices such as CMOSs and CCDs are formed or a substrate on which optical devices such as filters and optical pickup devices are formed, there is a possibility that the adhesion of cut dust to the devices may cause poor quality of the devices. Accordingly, great importance is placed on the removal of the cut dust to prevent the adhesion of the cut dust to the workpiece. Once the cut dust sticks to the workpiece and then dries, it is very difficult to remove the cut dust in a subsequent cleaning step. To cope with this problem, there has been proposed a technique of supplying a cleaning water to the upper surface of a workpiece during cutting to thereby prevent the adhesion of cut dust as disclosed in Japanese Patent Laid-open No. 2006-231474, for example.

SUMMARY OF THE INVENTION

In the case of usually supplying a cutting fluid to the cutting blade in cutting the workpiece, the cut dust generated in cutting is partially captured by the cutting fluid and moved with the cutting blade in association with the rotation of the cutting blade. When the cutting fluid is sprayed to the cutting blade during cutting, the cutting fluid containing the cut dust being rotated with the cutting blade may be scattered onto the workpiece, causing a problem that the upper surface of the workpiece is soiled as a whole. Accordingly, even when the cleaning water is supplied to the workpiece as disclosed in Japanese Patent Laid-open No. 2006-231474, the flow of the cleaning water supplied to the workpiece may be disturbed by the cutting fluid scattered onto the workpiece, so that there arises a problem that an insufficiently cleaned area is left on the workpiece and the cut dust on the workpiece cannot be completely removed.

It is therefore an object of the present invention to provide a cutting apparatus which can reduce the possibility that the cut dust may stick to the workpiece.

In accordance with an aspect of the present invention, there is provided a cutting apparatus including holding means for holding a workpiece; a cutting blade for cutting the workpiece held by the holding means; a spindle unit including a spindle for rotatably supporting the cutting blade; a blade cover mounted on the spindle unit for covering the cutting blade, the blade cover having a bottom portion formed with an opening from which the lower end of the cutting blade projects; and cutting fluid supplying means for supplying a cutting fluid to the upper surface of the workpiece in the periphery of the opening of the blade cover; the blade cover having a blade accommodating portion as an inside space for accommodating the cutting blade, the blade cover being formed with a discharge opening communicating with the blade accommodating portion and connected to a vacuum source; whereby the cutting fluid supplied to the upper surface of the workpiece is taken from the opening into the blade accommodating portion of the blade cover in association with the rotation of the cutting blade and thereafter discharged from the discharge opening to the outside of the blade cover.

In the present invention, a cutting fluid is supplied from the cutting fluid supplying means to the upper surface of the workpiece in the condition where the vacuum source is operated. The cutting fluid supplied to the upper surface of the workpiece is moved to a cutting point where the cutting blade comes into contact with the workpiece and functions to capture cut dust generated in cutting the workpiece. Thereafter, the cutting fluid containing the cut dust is taken from the opening of the blade cover into the blade accommodating portion evacuated by the vacuum source. The cutting fluid is sucked in the blade accommodating portion toward the discharge opening of the blade cover and then discharged from the discharge opening. According to the present invention, the cutting fluid is not sprayed to the cutting blade, so that the cutting fluid containing the cut dust is not scattered on the workpiece, but it is sucked into the blade cover and discharged from the discharge opening as described above. As a result, it is possible to reduce the possibility that the cut dust may stick to the workpiece.

Preferably, the blade cover is formed with an air intake passage having one end opening to the outside of the blade cover and the other end communicating with the discharge opening. With this configuration, a fixed amount of outside air is always sucked through the air intake passage to the discharge opening by the vacuum source. Accordingly, it is possible to reduce the possibility that the discharge opening may be fully clogged with the cutting fluid, thereby preventing variations in suction amount of the cutting fluid.

Preferably, the cutting fluid supplying means includes a cutting fluid nozzle formed at the bottom portion of the blade cover in the vicinity of the opening; and a cutting fluid passage having one end connected to the cutting fluid nozzle and the other end connected to a cutting fluid source. With this configuration, the cutting fluid supplying means is built in the blade cover, so that space saving can be effected.

Preferably, the cutting blade has a cutting edge formed along the outer circumference; the blade cover is provided with blade detecting means including a light emitting portion and a light receiving portion opposed to each other; the blade cover has a first insertion hole for allowing the insertion of the light emitting portion and a second insertion hole for allowing the insertion of the light receiving portion, the light emitting portion and the light receiving portion being respectively inserted in the first insertion hole and the second insertion hole with the cutting edge interposed therebetween; the side wall of the first insertion hole is formed with a light outlet opening to the blade accommodating portion for allowing the emergence of detection light emitted from the light emitting portion toward the light receiving portion; the side wall of the second insertion hole is formed with a light inlet opening to the blade accommodating portion for allowing the entrance of the detection light emitted from the light emitting portion toward the light receiving portion; the blade cover is formed with a first air intake passage having one end opening to the outside of the blade cover and the other end communicating with the light outlet, the light emitting portion having a light emitting surface exposed to the first air intake passage; and the blade cover is further formed with a second air intake passage having one end opening to the outside of the blade cover and the other end communicating with the light inlet, the light receiving portion having a light receiving surface exposed to the second air intake passage.

With this configuration, the optical blade detecting means having the light emitting portion and the light receiving portion functions to detect wear or damage of the cutting edge of the cutting blade. Further, the outside air is taken through the first and second air intake passages and passed along the light emitting surface of the light emitting portion and the light receiving surface of the light receiving portion, then reaching the light outlet opposed to the light emitting surface and the light inlet opposed to the light receiving surface. Thus, the outside air flowing in the first and second air intake passages come into touch with the light emitting surface and the light receiving surface to thereby reduce the adhesion of soil to the light emitting surface and the light receiving surface. As a result, it is possible to prevent a reduction in detection accuracy for wear or damage of the cutting edge.

Preferably, the spindle unit includes an air spindle unit such that the spindle is supported by an air bearing; and the blade cover has a spindle inserting portion for allowing the insertion of the spindle and a spindle purge air suction passage having one end connected to the spindle inserting portion and the other end connected to the vacuum source, whereby pressure air discharged from the spindle inserting portion toward the cutting blade is sucked through the spindle purge air suction passage.

With this configuration, the pressure air forming the air bearing in the spindle unit is discharged as a spindle purge air out of the spindle unit through the spindle inserting portion. The spindle purge air is sucked through the spindle purge air suction passage by the vacuum source, thereby suppressing the flow of the spindle purge air toward the cutting blade. As a result, it is possible to reduce the possibility that the flow of the cutting fluid being sucked in the blade accommodating portion toward the discharge opening may be disturbed by the spindle purge air.

Preferably, the opening of the blade cover is composed of a wide opening formed on the leading side in the rotational direction of the cutting blade and a narrow opening formed on the trailing side in the rotational direction of the cutting blade so as to communicate with the wide opening; and the blade accommodating portion has an area where the cutting blade rotates upward from the opening to the discharge opening, the area being formed as a wide portion having a width almost equal to the width of the wide opening. At the cutting point, the cut dust in the cutting fluid flows to the leading side in the moving direction of the workpiece with respect to the cutting point in association with the rotation of the cutting blade. Accordingly, the cut dust is present more on the leading side in the moving direction of the workpiece than on the trailing side in the moving direction of the workpiece. In view of this fact, the wide opening is formed at the bottom of the blade cover on the leading side in the rotational direction of the cutting blade and the wide portion is formed as an area of the blade accommodating portion ranging from the wide opening to the discharge opening. Accordingly, the cutting fluid containing the cut dust present on the leading side in the moving direction of the workpiece can be more effectively sucked into the blade accommodating portion and discharged from the discharge opening.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Some preferred embodiments of the present invention will now be described with reference to the drawings.

(1) Overall Configuration of Cutting Apparatus

Figure 1:
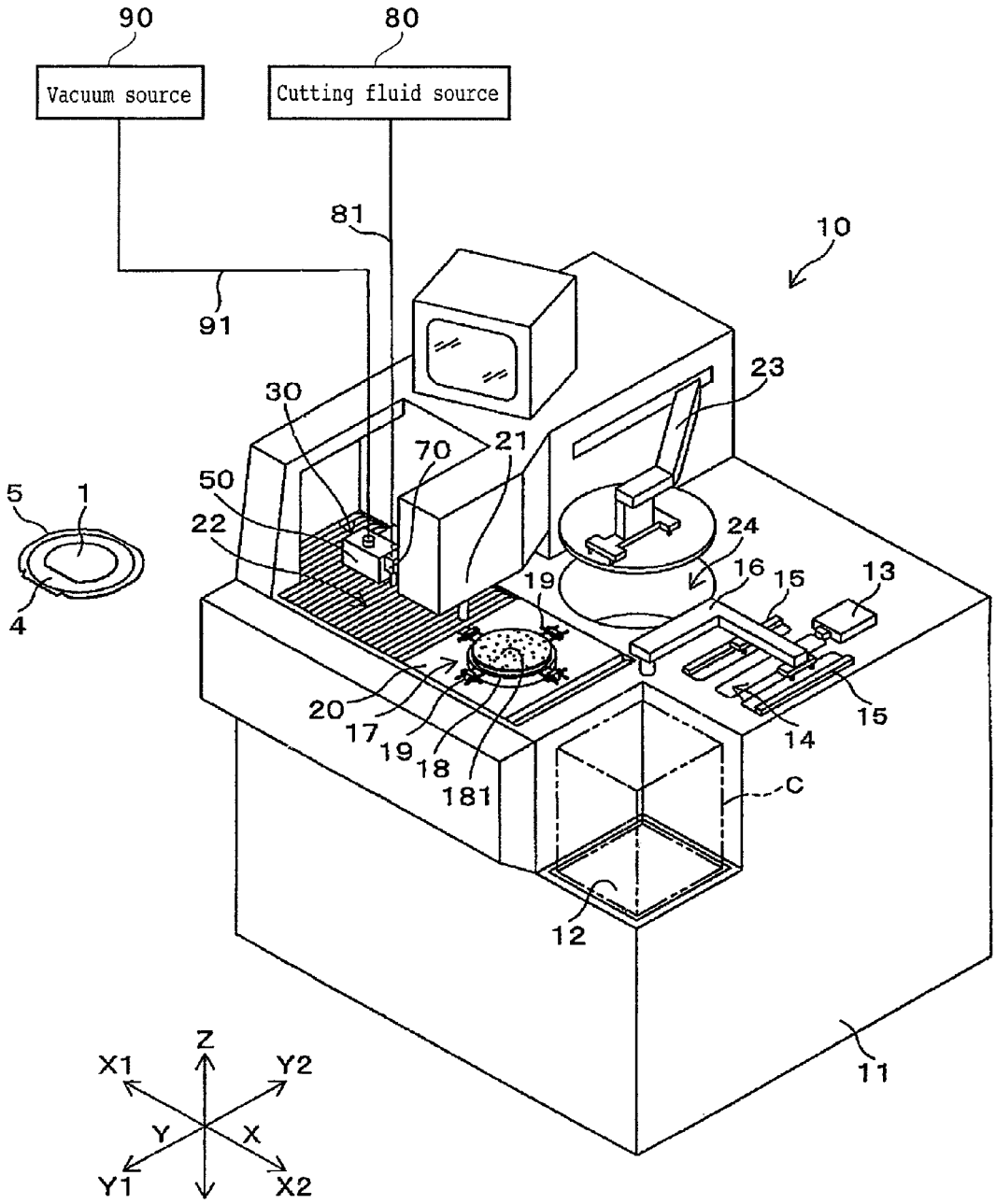
FIG. 1 is a perspective view showing a cutting apparatus and a workpiece according to a first preferred embodiment of the present invention.

There will now be described an overall configuration of a cutting apparatus 10 according to a first preferred embodiment of the present invention. The cutting apparatus 10 is suitable as an apparatus for dividing a disk-shaped workpiece 1 such as a semiconductor wafer into a plurality of chips. A plurality of crossing division lines are set on the front side of the workpiece 1 shown in FIG. 1, and the workpiece 1 is cut along the division lines by the cutting apparatus 10 to obtain the plural chips. In this case, the workpiece 1 is supported through an adhesive tape 4 to an annular frame 5 in the condition where the workpiece 1 is attached to the adhesive tape 4 inside the annular frame 5 and the front side of the workpiece 1 is exposed. A plurality of such workpieces 1 each supported through the adhesive tape 4 to the annular frame 5 are stored in a cassette C at vertically different stages. In transferring each workpiece 1, the frame 5 is held in the cutting apparatus 10. In FIG. 1, reference symbols X and Y denote horizontal directions perpendicular to each other, and reference symbol Z denotes a vertical direction.

As shown in FIG. 1, the cassette C storing the plural workpieces 1 each supported to the frame 5 is detachably set on a cassette table 12 provided at a corner portion of a base 11. The cassette table 12 is of an elevator type adapted to be vertically moved. Accordingly, when the cassette table 12 is vertically moved, a selected one of the workpieces 1 stored in the cassette C is set to a load/unload position at a predetermined level from the base 11. The workpiece 1 thus set to the load/unload position is next drawn in the direction shown by an arrow Y2 to a temporary position 14 by clamp type loading/unloading means 13. At the temporary position 14, the workpiece 1 is temporarily placed on a pair of centering guides 15 spaced from each other in the lateral direction (the X direction).

The centering guides 15 are configured by a pair of platelike members each having an L-shaped cross section and extending in the Y direction, wherein the pair of platelike members are arranged symmetrically in the X direction. Further, the centering guides 15 are movable in the X direction so as to be moved toward or away from each other. The frame 5 supporting the workpiece 1 is placed on the centering guides 15, and the centering guides 15 are moved toward each other in the X direction to nip the outer circumference of the frame 5. In this manner, the workpiece 1 is set at a transfer start position in the temporary position 14.

The workpiece 1 is next transferred from the temporary position 14 to a standby position 17 by first transfer means 16 adapted to be pivotably moved. In FIG. 1, disk-shaped holding means 18 is set at the standby position 17. The holding means 18 has a holding surface 181 for horizontally holding the workpiece 1 under suction. A plurality of frame clamps 19 are fixedly mounted on the outer circumference of the holding means 18. The holding surface 181 has substantially the same size as that of the workpiece 1. The workpiece 1 is placed on the holding surface 181 through the adhesive tape 4 and then held under suction. Further, the frame 5 is fixed by the frame clamps 19.

The holding means 18 is rotatably supported on a movable table 20. The movable table 20 is movable in the X direction by a moving mechanism (not shown). The holding means 18 is rotatable by a rotating mechanism (not shown), so that the workpiece 1 held on the holding means 18 is rotated by the rotation of the holding means 18. After holding the workpiece 1 on the holding means 18, the front side (upper surface) of the workpiece 1 is imaged by alignment means 21 provided above the standby position 17. The alignment means 21 performs necessary processing such as pattern matching to detect the division lines set on the front side of the workpiece 1.

Figure 2:
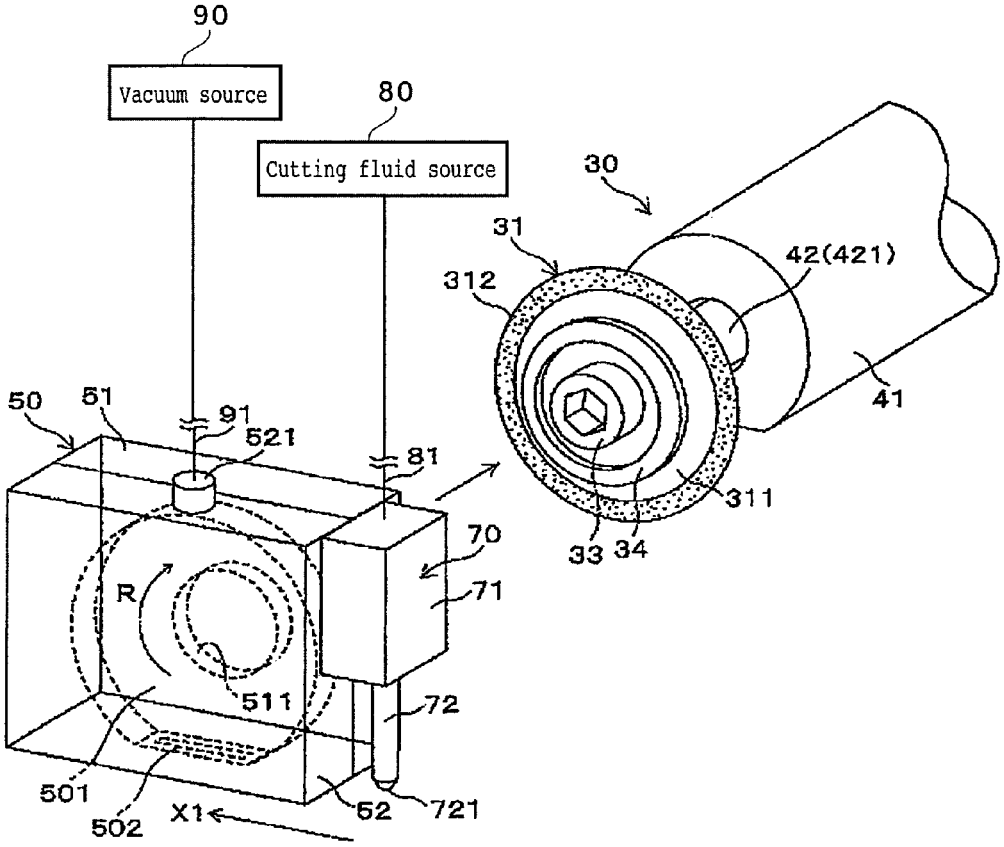
FIG. 2 is a perspective view of cutting means included in the cutting apparatus shown in FIG. 1, showing the condition where a blade cover is demounted from a spindle unit.
Figure 3:
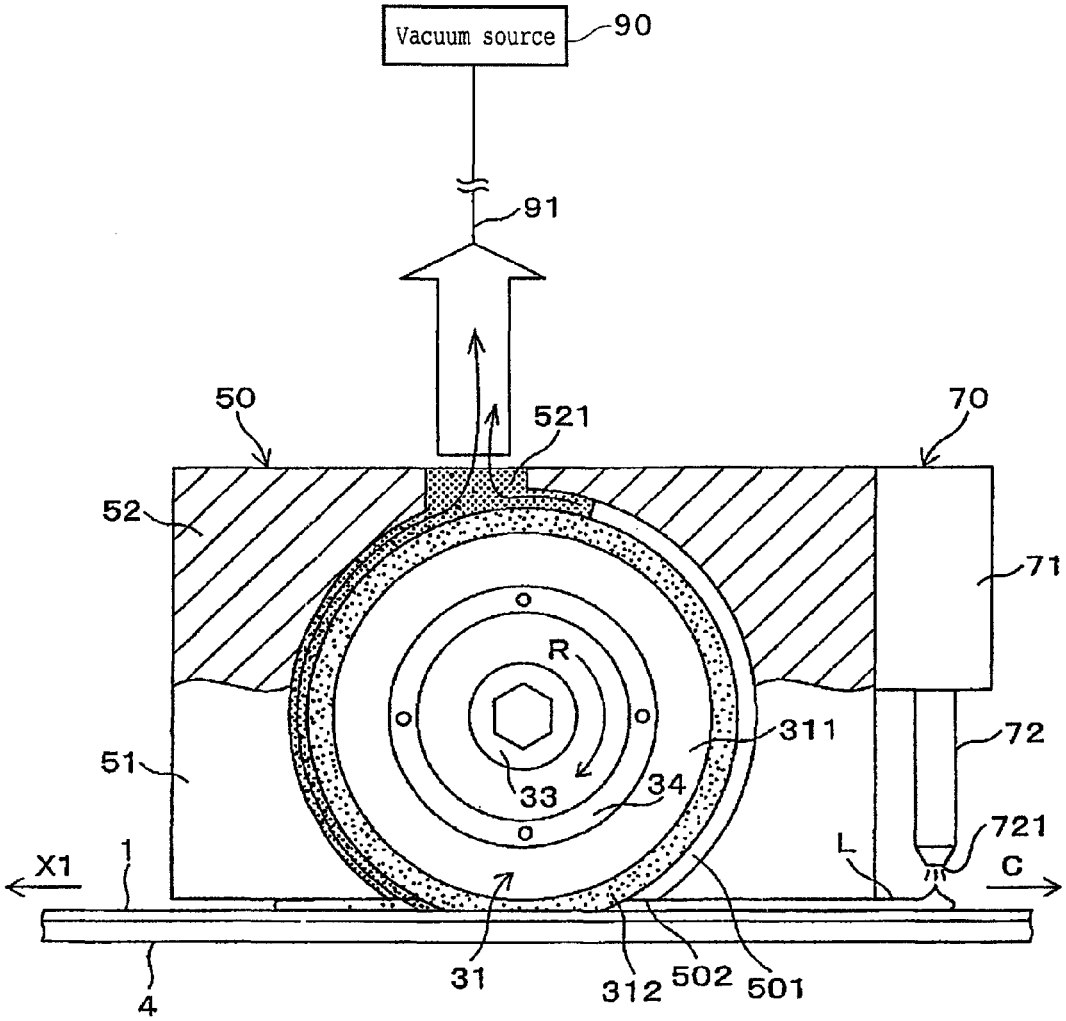
FIG. 3 is a partially sectional side view of the cutting means shown in FIG. 2, showing an operation such that a cutting fluid is discharged through the blade cover.

Thereafter, the movable table 20 is moved in the direction shown by an arrow X1 to thereby move the workpiece 1 to a work position 22. Cutting means 30 is provided above the work position 22. As shown in FIGS. 2 and 3, the cutting means 30 includes a cutting blade 31, a spindle unit 40 having an axis extending in the Y direction, and a blade cover 50 mounted on the spindle unit 40 for covering the cutting blade 31.

As shown in FIG. 2, the spindle unit 40 includes a hollow cylindrical housing 41 and a solid cylindrical spindle 42 rotatably supported in the spindle housing 41 and having an axis extending in the Y direction. The spindle 42 has a blade mounting shaft 421 formed at one end portion projecting from the spindle housing 41 in the direction shown by an arrow Y1. The cutting blade 31 having a disk-like shape is detachably mounted on the blade mounting shaft 421 of the spindle 42. The blade cover 50 for covering the cutting blade 31 is detachably fixed to the front end surface of the spindle housing 41.

The cutting means 30 is movable both in the Y direction and in the Z direction shown in FIG. 1 by Y and Z direction driving means (not shown). After the division lines of the workpiece 1 are detected by the alignment means 21, the cutting means 30 is indexed in the Y direction to align the cutting blade 31 with a predetermined one of the division lines of the workpiece 1.

After performing the alignment between the cutting blade 31 and the predetermined division line of the workpiece 1 in the Y direction, the cutting means 30 is lowered to set the lower end of the cutting blade 31 at a predetermined cutting level with respect to the workpiece 1. Thereafter, the movable table 20 is moved in the X1 direction to feed the workpiece 1 in the X1 direction. Accordingly, the cutting blade 31 is relatively moved along the predetermined division line in the direction shown by an arrow X2 to thereby cut the workpiece 1 along the predetermined division line. Thereafter, the cutting means 30 is indexed in the Y direction by the pitch of the division lines and the workpiece 1 is fed in the X1 direction along the next division line. This index and feed operations are repeated to cut the workpiece 1 along all of the division lines extending in the X direction.

In the cutting of the workpiece 1, the workpiece 1 is fed in only the X1 direction. Further, the cutting blade 31 is rotated in the direction shown by an arrow R in FIG. 3. The rotational direction R of the cutting blade 31 is set to perform down cut such that a cutting edge 312 of the cutting blade 31 cuts into the workpiece 1 from the upper surface toward the lower surface thereof on the leading side in the relatively moving direction X2 of the cutting blade 31 in feeding the workpiece 1 in the X1 direction.

Thereafter, the holding means 18 is rotated 90° to thereby rotate the workpiece 1 until the remaining division lines perpendicular to the division lines already cut become parallel to the X direction. Thereafter, the workpiece 1 is similarly cut along the remaining division lines extending in the X direction. Thus, the workpiece 1 is cut along all of the division lines set on the front side of the workpiece 1 to thereby obtain a plurality of individual chips. These plural individual chips remain attached to the adhesive tape 4, so that the form of the disk-shaped workpiece 1 is maintained. During cutting of the workpiece 1, a cutting fluid is supplied from cutting fluid supplying means 70 to the upper surface of the workpiece 1. The cutting fluid supplying means 70 is provided on the blade cover 50 in this preferred embodiment. The configurations of the cutting blade 31 and the cutting fluid supplying means 70 will be hereinafter described in detail.

After dividing the workpiece 1 into the individual chips as mentioned above, the movable table 20 is moved in the X2 direction to return the holding means 18 to the standby position 17 and cancel the suction holding of the workpiece 1 on the holding means 18. Thereafter, the workpiece 1 is transferred from the standby position 17 to cleaning means 24 by second transfer means 23. The cleaning means 24 is located on the back side of the standby position 17 in the Y2 direction and on the left side of the temporary position 14 in the X1 direction as viewed in FIG. 1. The workpiece 1 is cleaned with water and dried by the cleaning means 24. Thereafter, the workpiece 1 is transferred to the temporary position 14 by the first transfer means 16 and positioned by the centering guides 15. Thereafter, the workpiece 1 is returned to the cassette C by the loading/unloading means 13. The cutting operation mentioned above is one cycle of operation for one of the plural workpieces 1 stored in the cassette C, and this cycle is performed to all of the workpieces 1.

(2) Cutting Blade and Spindle

Figure 4:
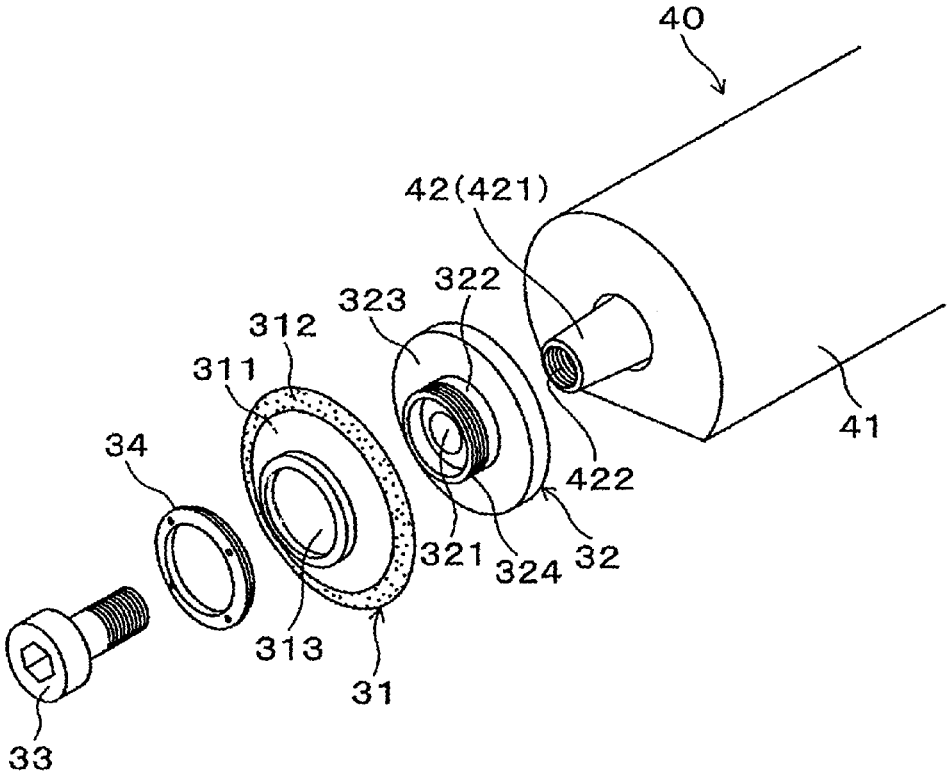
FIG. 4 is an exploded perspective view showing a mounting structure of a cutting blade to a spindle constituting the cutting means.

As shown in FIG. 4, the cutting blade 31 is detachably mounted on the blade mounting shaft 421 coaxially formed at the front end of the spindle 42. The blade mounting shaft 421 is tapered in such a manner that the outer diameter of the blade mounting shaft 421 is gradually decreased toward the front end. The blade mounting shaft 421 is formed with a tapped hole 422 extending in the axial direction of the shaft 421. The cutting blade 31 to be mounted on the blade mounting shaft 421 is composed of an annular hub 311 and an annular cutting edge 312 fixed to one side of the annular hub 311 (on the spindle 42 side) along the outer circumference thereof. A blade mount 32 is interposed between the cutting blade 31 and the blade mounting shaft 421. The blade mount 32 has a cylindrical portion 322 and a flange portion 323 formed on the outer circumferential surface of the cylindrical portion 322 at an axially intermediate position thereof. The cylindrical portion 322 is coaxially formed with a tapering mount hole 321 for snugly engaging the blade mounting shaft 421. Further, a male screw 324 is formed on the outer circumferential surface of the cylindrical portion 322 at a front portion thereof with respect to the flange portion 323.

The cutting blade 31 is mounted to the blade mounting shaft 421 in the following manner. First, the mount hole 321 of the blade mount 32 is fitted to the blade mounting shaft 421, and a bolt 33 is threadedly engaged with the tapped hole 422 of the blade mounting shaft 421. Accordingly, the blade mount 32 is forced toward the spindle 42 by the bolt 33, so that the blade mounting shaft 421 is press-fitted in the mount hole 321 of the blade mount 32. Thus, the blade mount 32 is fastened to the blade mounting shaft 421. Thereafter, a center hole 313 of the hub 311 constituting the cutting blade 31 is fitted to the cylindrical portion 322 of the blade mount 32, and a nut 34 is threadedly engaged with the male screw 324 of the blade mount 32, thereby pressing the hub 311 against the blade mount 32 to fasten the hub 311 to the blade mount 32. Accordingly, the cutting blade 31 is mounted through the blade mount 32 to the blade mounting shaft 421 formed at the front end of the spindle 42.

The spindle unit 40 including the spindle 42 having the blade mounting shaft 421 for mounting the cutting blade 31 is configured by an air spindle unit such that the spindle 42 in the spindle housing 41 is supported by an air bearing. More specifically, the spindle unit 40 is provided with an air supplying mechanism for supplying high-pressure air into the spindle housing 41 to thereby form an air bearing for supporting the spindle 42 in a radial direction and an axial direction. Further, a motor (not shown) for rotationally driving the spindle 42 is provided in the spindle housing 41. For example, this motor is composed of a rotor provided at the rear end portion of the spindle 42 and a stator provided on the inner wall of the spindle housing 41. Accordingly, the spindle 42 is rotatably supported by the air bearing formed by the high-pressure air supplied into the spindle housing 41 from the air supplying mechanism, and is rotationally driven by the motor mentioned above.

(3-1) Blade Cover and Cutting Fluid Supplying Means in the First Preferred Embodiment The blade cover 50 fixed to the front end surface of the spindle housing 41 has a boxlike shape as a whole, and it is composed of an inner cover 51 and an outer cover 52 joined to each other in the Y direction shown in FIG. 1. The inner cover 51 and the outer cover 52 are fixedly joined by any means such as screws and magnets. The shape of the blade cover 50 is not limited to such a boxlike shape, but various shapes may be designed as required. For example, a circular shape with a horizontally cut lower end may be used.

Figure 5A:
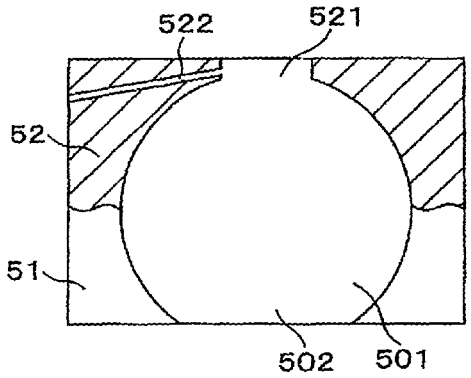
FIG. 5A is a partially sectional side view of the blade cover in the condition where a lower portion of an outer cover constituting the blade cover is cut away and an upper portion of the outer cover is shown in section.
Figure 5B:
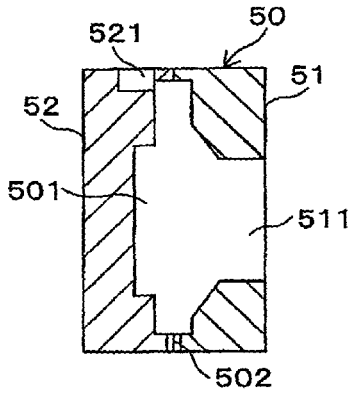
FIG. 5B is a vertical sectional view of the blade cover.
Figure 5C:
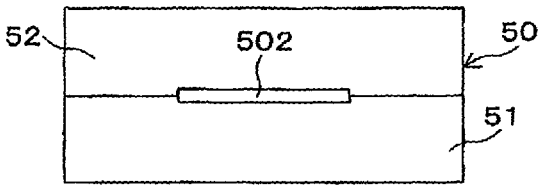
FIG. 5C is a bottom plan view of the blade cover.

As shown in FIG. 5B, the blade cover 50 has a blade accommodating portion 501 for accommodating the cutting blade 31. The blade accommodating portion 501 is defined as an inside space of the blade cover 50 configured by joining the inner cover 51 and the outer cover 52. The inner surface of the blade accommodating portion 501 has a substantially circular shape corresponding to the overall outer shape of the cutting blade 31, the blade mount 32, the bolt 33, and the nut 34. The split surface of the blade cover 50, i.e., the joined surface between the inner cover 51 and the outer cover 52 is positioned so as to correspond to the outer circumference of the cutting edge 312 of the cutting blade 31. The bottom portion of the blade cover 50 is formed with a slit-like opening 502 for allowing the projection of a lower end of the cutting edge 312 of the cutting blade 31 by a predetermined amount. The opening 502 is formed by cutting the inner surfaces of the inner cover 51 and the outer cover 52. Accordingly, the workpiece 1 is cut by the cutting edge 312 projecting from the opening 502.

The inner cover 51 has a spindle inserting portion 511 as an opening for allowing the insertion of the blade mounting shaft 421 of the spindle 42. In the condition where the blade mounting shaft 421 is inserted in the spindle inserting portion 511, the cutting blade 31 is accommodated into the blade accommodating portion 501. In the condition where the cutting blade 31 is accommodated in the blade accommodating portion 501, the lower end of the cutting edge 312 of the cutting blade 31 projects from the opening 502 and the other portion of the cutting blade 31 is covered with the blade cover 50. The top portion of the outer cover 52 is formed with a discharge opening 521 communicating with the blade accommodating portion 501. A vacuum source 90 is connected through a vacuum line 91 to the discharge opening 521. As shown in FIG. 5A, the outer cover 52 is formed with an air intake passage 522 having one end opening to the side surface of the outer cover 52 on the X1 side shown in FIG. 1 and the other end communicating with the discharge opening 521.

As shown in FIGS. 2 and 3, the cutting fluid supplying means 70 for supplying a cutting fluid to the upper surface of the workpiece 1 in the periphery of the opening 502 is provided on the side surface of the blade cover 50 on the X2 side shown in FIG. 1. The cutting fluid supplying means 70 includes a cutting fluid pipe block 71 for storing a cutting fluid such as pure water, a cutting fluid pipe 72 extending downward from the cutting fluid pipe block 71, and a cutting fluid nozzle 721 formed at the lower end of the cutting fluid pipe 72 for downwardly discharging the cutting fluid supplied from the cutting fluid pipe block 71 through the cutting fluid pipe 72. A cutting fluid source 80 is connected through a cutting fluid line 81 to the cutting fluid pipe block 71. The cutting fluid pipe block 71 is fixed to the inner cover 51 or the outer cover 52, thereby fixing the cutting fluid supplying means 70 to the blade cover 50.

The blade cover 50 is fixed to the front end surface of the spindle housing 41 in the following manner. The blade mounting shaft 421 of the spindle 42 is inserted into the spindle inserting portion 511 of the inner cover 51. Thereafter, the inner cover 51 is fixed to the front end surface of the spindle housing 41 by any fixing means such as screws. Thereafter, the cutting blade 31 is mounted to the blade mounting shaft 421 in the manner described above. Thereafter, the outer cover 52 is fixed to the inner cover 51.

(3-2) Operation of the First Preferred Embodiment

The operation of the blade cover 50 and the cutting fluid supplying means 70 in the first preferred embodiment will now be described. As described above, the workpiece 1 held on the holding means 18 is cut by moving the movable table 20 in the X1 direction shown in FIG. 1 and lowering the cutting blade 31 being rotated to the predetermined cut level with respect to the workpiece 1. During this cutting, a cutting fluid L is discharged from the cutting fluid nozzle 721 of the cutting fluid supplying means 70 and supplied to the upper surface of the workpiece 1 in the periphery of the opening 502 of the blade cover 50 as shown in FIG. 3. At the same time, the vacuum source 90 is operated to suck the air present in the blade accommodating portion 501 of the blade cover 50, thereby producing a vacuum in the blade accommodating portion 501.

As shown in FIG. 3, the cutting fluid L is supplied to the upper surface of the workpiece 1 at a position outside the blade cover 50 on the leading side in the relatively moving direction X2 of the cutting blade 31. The cutting fluid L supplied to the upper surface of the workpiece 1 is fed in the X1 direction together with the workpiece 1 to enter the space between the blade cover 50 and the workpiece 1 and thereafter reach a cutting point where the cutting blade 31 being rotated in the direction R cuts the workpiece 1 in the down-cut manner. At the cutting point, the cutting fluid functions to capture cut dust generated in cutting the workpiece 1. The cutting fluid thus containing the cut dust is taken from the opening 502 into the blade accommodating portion 501 by the rotation of the cutting blade 31 and thereafter sucked by the vacuum source 90. Finally, the cutting fluid containing the cut dust is discharged from the discharge opening 521 to the outside of the blade cover 50.

In this preferred embodiment, the cutting fluid L is not directly sprayed to the cutting blade 31 being rotated. Accordingly, there is no possibility that the cutting fluid L containing the cut dust may be scattered on the workpiece 1. Since the cutting blade 31 is covered with the blade cover 50, the cutting fluid L containing the cut dust is sucked into the blade accommodating portion 501 from the opening 502 of the blade cover 50 and next discharged from the discharge opening 521. As a result, the cutting fluid L containing the cut dust is prevented from scattering out of the blade cover 50, thereby reducing the possibility that the cut dust may stick to the upper surface of the workpiece 1.

Further, when the cutting fluid L in the blade accommodating portion 501 is sucked by the vacuum source 90, the outside air is sucked through the air intake passage 522 communicating with the discharge opening 521 by the vacuum source 90 to enter the discharge opening 521 under suction. Accordingly, a fixed amount of outside air is always introduced from the air intake passage 522 to the discharge opening 521 by the vacuum source 90. As a result, it is possible to prevent that the discharge opening 521 may be fully clogged with the cutting fluid L, so that variations in amount of the cutting fluid L to be sucked can be suppressed to thereby achieve stable suction of the cutting fluid L.

(4-1) Second Preferred Embodiment

Figure 6A:
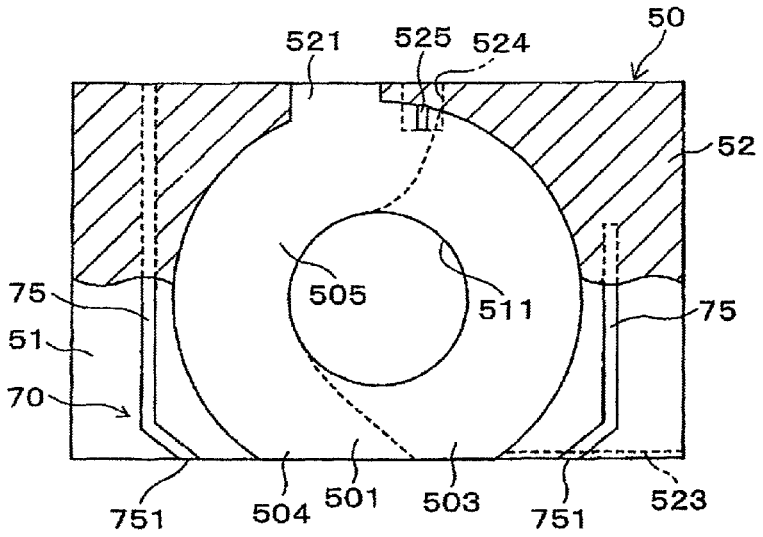
FIG. 6A is a partially sectional side view of a blade cover according to a second preferred embodiment of the present invention in the condition where a lower portion of an outer cover constituting the blade cover is cut away and an upper portion of the outer cover is shown in section.
Figure 6B:
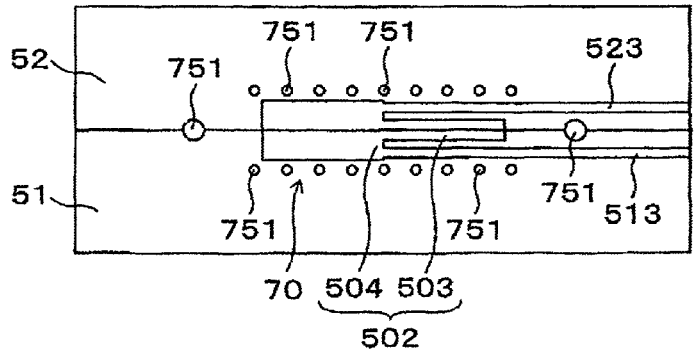
FIG. 6B is a bottom plan view of the blade cover according to the second preferred embodiment.

A blade cover 50 and cutting fluid supplying means 70 according to a second preferred embodiment of the present invention will now be described with reference to FIGS. 6A to 8. The basic structure of the blade cover 50 according to the second preferred embodiment is the same as that of the blade cover 50 according to the first preferred embodiment, but there is a difference in the following points. As shown in FIG. 6B, the opening 502 formed at the bottom portion of the blade cover 50 for allowing the projection of the cutting edge 312 has a different shape. That is, the width of a portion (left portion as viewed in FIG. 6B) of the opening 502 on the leading side in the rotational direction of the cutting blade 31 is set larger than the width of a portion (right portion as viewed in FIG. 6B) of the opening 502 on the trailing side in the rotational direction of the cutting blade 31. In other words, the opening 502 is composed of a narrow opening 503 formed on the trailing side in the rotational direction of the cutting blade 31 and a wide opening 504 formed on the leading side in the rotational direction of the cutting blade 31 so as to communicate with the narrow opening 503.

The blade accommodating portion 501 defined in the blade cover 50 has an area (space on the left side of a broken line in the blade accommodating portion 501) where the cutting blade 31 rotates upward from the opening 502 to the discharge opening 521. This area in the blade accommodating portion 501 is formed as a wide portion 505 having a width almost equal to the width of the wide opening 504 (distance in the Y direction shown in FIG. 1). In this preferred embodiment, the discharge opening 521 of the blade cover 50 is formed at the top portions of the inner cover 51 and the outer cover 52. Accordingly, the discharge opening 521 is formed by joining the inner cover 51 and the outer cover 52. The other area of the blade accommodating portion 501 on the right side of the broken line shown in FIG. 6A has the same width as that of the narrow opening 503.

Figure 7:
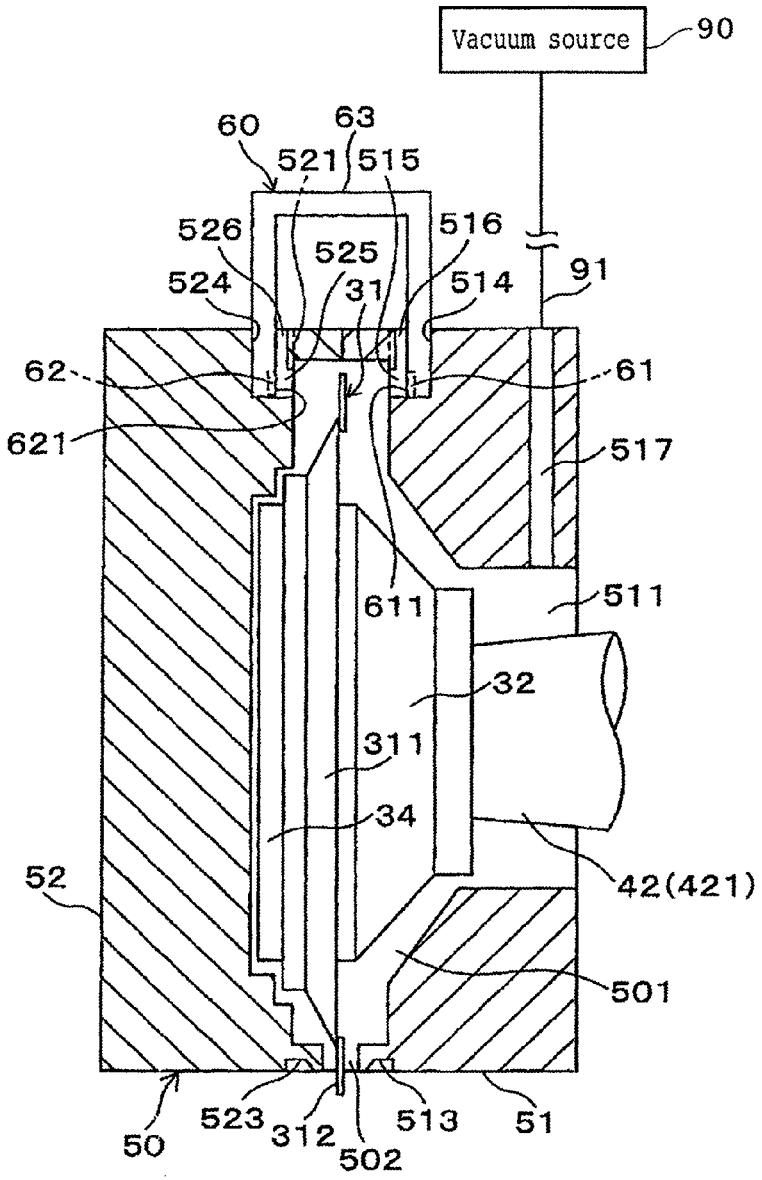
FIG. 7 is a vertical sectional view of the blade cover according to the second preferred embodiment.

As shown in FIGS. 6B and 7, a pair of groove-like air intake passages 513 and 523 are formed on the bottom surfaces of the inner cover 51 and the outer cover 52, respectively, on the opposite sides of the narrow opening 503. Each of the air intake passages 513 and 523 has one end opening to the right side surface of the blade cover 50 (on the X2 side as viewed in FIG. 1) and the other end communicating with the wide opening 504. These air intake passages 513 and 523 are in communication with the discharge opening 521 through the wide opening 504 and the blade accommodating portion 501.

Figure 8:
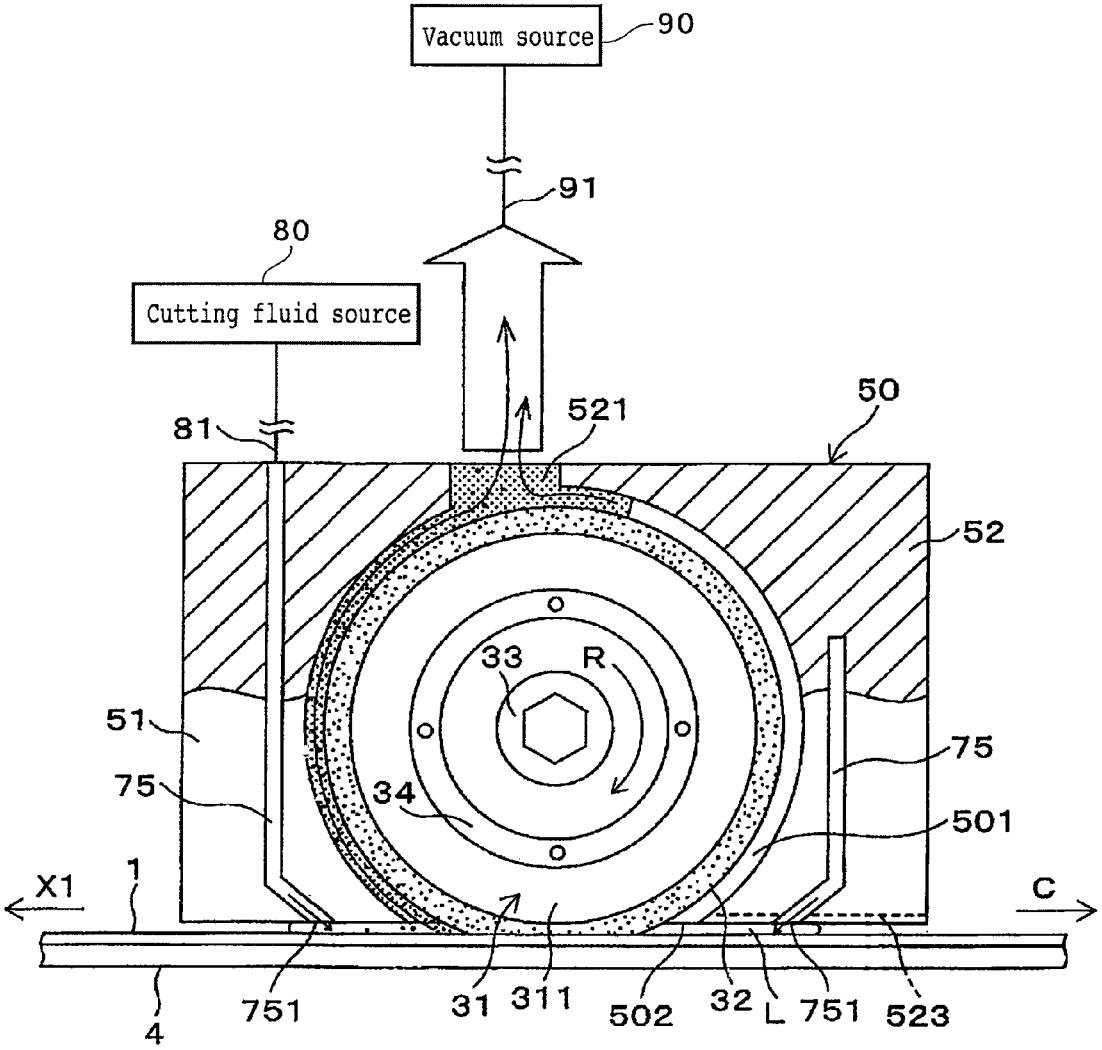
FIG. 8 is a partially sectional side view of cutting means according to the second preferred embodiment, showing an operation such that a cutting fluid is discharged through the blade cover shown in FIG. 7.

The cutting fluid supplying means 70 in this preferred embodiment is provided in the blade cover 50. As shown in FIGS. 6A and 6B, a plurality of cutting fluid nozzles 751 are formed on the bottom surface of the blade cover 50 so as to surround the narrow opening 503 and the wide opening 504. Further, a plurality of cutting fluid passages 75 are formed in the blade cover 50 so as to respectively communicate with the plural cutting fluid nozzles 751. These plural cutting fluid passages 75 are in communication with each other. Thus, the cutting fluid supplying means 70 in this preferred embodiment is composed of the plural cutting fluid nozzles 751 and the plural cutting fluid passages 75. One of the plural cutting fluid passages 75 opens to the top surface of the outer cover 52 and is connected through a cutting fluid line 81 to a cutting fluid source 80 as shown in FIG. 8.

As shown in FIG. 7, a light emitting portion insertion hole 514 is formed at an upper portion of the inner cover 51 so as to open to the upper surface thereof. Similarly, a light receiving portion insertion hole 524 is formed at an upper portion of the outer cover 52 so as to open to the upper surface thereof. The light emitting portion insertion hole 514 and the light receiving portion insertion hole 524 are formed in a pair. A light emitting portion 61 and a light receiving portion 62 constituting blade detecting means 60 are inserted in these insertion holes 514 and 524, respectively, in such a manner as to face each other with the outer circumferential portion of the cutting edge 312 interposed therebetween.

A U-shaped supporting frame 63 is inserted at its opposite end portions in the insertion holes 514 and 524, and the light emitting portion 61 and the light receiving portion 62 are fixed to the opposite end portions of the U-shaped supporting frame 63 so as to face each other. Detection light is emitted from the light emitting portion 61 and received by the light receiving portion 62. The side wall of the light emitting portion insertion hole 514 on the blade accommodating portion 501 side is formed with a light outlet 515 opening to the blade accommodating portion 501 for allowing the emergence of the detection light emitted from the light emitting portion 61 toward the light receiving portion 62. On the other hand, the side wall of the light receiving portion insertion hole 524 on the blade accommodating portion 501 side is formed with a light inlet 525 opening to the blade accommodating portion 501 for allowing the entrance of the detection light emitted from the light emitting portion 61 toward the light receiving portion 62.

Further, as shown in FIG. 7, an air intake passage 516 is formed in the inner cover 51 at a position inside the supporting frame 63, and an air intake passage 526 is formed in the outer cover 52 at a position inside the supporting frame 63. The air intake passage 516 opens at one end thereof to the upper surface of the inner cover 51, passes along a light emitting surface 611 of the light emitting portion 61, and communicates at the other end with the light outlet 515. On the other hand, the air intake passage 526 opens at one end thereof to the upper surface of the outer cover 52, passes along a light receiving surface 621 of the light receiving portion 62, and communicates at the other end with the light inlet 525.

Further, as shown in FIG. 7, a spindle purge air suction passage 517 is formed in the inner cover 51. The spindle purge air suction passage 517 has one end connected to the spindle inserting portion 511 and the other end connected to the vacuum source 90. The high-pressure air forming the air bearing in the spindle housing 41 is discharged as a spindle purge air, so as to prevent the cutting fluid containing the cut dust from entering the spindle housing 41. In this preferred embodiment, the spindle purge air discharged toward the cutting blade 31 is sucked by the vacuum source 90 to pass through the spindle purge air suction passage 517 formed in the inner cover 51.

(4-2) Operation of the Second Preferred Embodiment

During cutting of the workpiece 1 by the cutting blade 31, the cutting fluid source 80 is operated to supply the cutting fluid L to the cutting fluid passages 75 formed in the blade cover 50 and then discharge the cutting fluid L from the cutting fluid nozzles 751. At the same time, the vacuum source 90 is operated to suck the air present in the blade accommodating portion 501 and the spindle purge air suction passage 517 formed in the blade cover 50, thereby producing a vacuum in the blade accommodating portion 501 and the suction passage 517.

As shown in FIG. 8, the cutting fluid L discharged from the cutting fluid nozzles 751 is supplied to the upper surface of the workpiece 1 in the periphery of the opening 502 of the blade cover 50 so as to surround the cutting edge 312 of the cutting blade 31. The cutting fluid L supplied to the upper surface of the workpiece 1 is fed in the X1 direction together with the workpiece 1 to reach a cutting point where the cutting blade 31 being rotated in the direction R cuts the workpiece 1 in the down-cut manner. At the cutting point, the cutting fluid L functions to capture cut dust generated in cutting the workpiece 1. The cutting fluid L thus containing the cut dust is taken from the opening 502 into the blade accommodating portion 501 by the rotation of the cutting blade 31 and thereafter sucked by the vacuum source 90. Finally, the cutting fluid L containing the cut dust is discharged from the discharge opening 521 to the outside of the blade cover 50. Accordingly, the cutting fluid L containing the cut dust is prevented from scattering out of the blade cover 50, thereby reducing the possibility that the cut dust may stick to the upper surface of the workpiece 1.

At the cutting point of the cutting blade 31 to the workpiece 1, the cut dust in the cutting fluid L flows to the leading side in the moving direction of the workpiece 1, or in the feeding direction (X1 side), with respect to the cutting point in association with the rotation of the cutting blade 31. Accordingly, the cut dust is present more on the leading side in the moving direction of the workpiece 1 than on the trailing side in the moving direction of the workpiece 1. In view of this fact, the wide opening 504 is formed on the bottom surface of the blade cover 50 as a portion of the opening 502 on the leading side in the rotational direction of the cutting blade 31. Furthermore, the wide portion 505 is formed as an area of the blade accommodating portion 501 ranging from the wide opening 504 to the discharge opening 521. Accordingly, the cutting fluid L containing the cut dust present on the leading side in the moving direction of the workpiece 1 can be more effectively sucked into the blade accommodating portion 501 and discharged from the discharge opening 521. As a result, it is possible to further improve the effect of reducing the adhesion of the cut dust to the upper surface of the workpiece 1.

The cutting point of the cutting blade 31 to the workpiece 1 is set on the leading side in the relatively moving direction of the cutting blade 31 (on the X2 side in FIG. 8) with respect to the center of the cutting blade 31. In view of this setting, the narrow opening 503 is formed as a portion of the opening 502 on the leading side in the relatively moving direction of the cutting blade 31. Accordingly, it is possible to prevent the possibility that the cutting fluid L supplied to the cutting point may be excessively sucked into the blade cover 50, so that cutting is performed with the cutting fluid L in a sufficient amount.

Further, the cutting fluid supplying means 70 in the second preferred embodiment is composed of the cutting fluid nozzles 751 and the cutting fluid passages 75 formed in the blade cover 50. Accordingly, space saving can be effected as compared with the first preferred embodiment. In addition, since the cutting fluid L can be supplied in the vicinity of the cutting point, a cutting fluid accumulation on the upper surface of the workpiece 1 can be reduced. There is a case that the cut dust generated in cutting may be suspended in the cutting fluid accumulation. If the cutting fluid accumulation is large, the cutting fluid L is not easily sucked into the blade cover 50 and the amount of the cutting fluid L moving away from the opening 502 is increased to cause easy adhesion of the workpiece 1. To cope with this problem, the cutting fluid supplying means 70 in the second preferred embodiment is formed in the blade cover 50, so that the cutting fluid L can be supplied in the vicinity of the cutting point to thereby reduce the cutting fluid accumulation. That is, enlargement of the cutting fluid accumulation can be suppressed to avoid the above problem.

Further, the outside air is sucked from the air intake passages 513 and 523 formed on the bottom surface of the blade cover 50 by operating the vacuum source 90 and supplied through the opening 502 and the blade accommodating portion 501 to the discharge opening 521. Accordingly, as similar to the first preferred embodiment, a fixed amount of outside air is always introduced from the air intake passages 513 and 523 to the discharge opening 521 by the vacuum source 90. As a result, it is possible to prevent that the discharge opening 521 may be fully clogged with the cutting fluid L, so that variations in amount of the cutting fluid L to be sucked can be suppressed to thereby achieve stable suction of the cutting fluid L.

In the blade detecting means 60, the detection light emitted from the light emitting portion 61 is normally interrupted by the cutting edge 312 and therefore does not enter the light receiving portion 62. In the event that the cutting edge 312 is worn or damaged, the detection light passes through the blade accommodating portion 501 and the light inlet 525 to enter the light receiving portion 62. When the detection light is detected by the light receiving portion 62, it is determined that the cutting edge 312 has been worn or damaged. In this case, the cutting blade 31 is inspected or replaced.

The light emitting surface 611 of the light emitting portion 61 is in communication with the blade accommodating portion 501 through the light outlet 515. Similarly, the light receiving surface 621 of the light receiving portion 62 is in communication with the blade accommodating portion 501 through the light inlet 525. Accordingly, there is a case that the cutting fluid L may stick to the light emitting surface 611 and the light receiving surface 621, so that these surfaces 611 and 621 may be soiled to cause a reduction in quantity of the detection light and accordingly cause a reduction in detection accuracy. To cope with this problem, the air intake passage 516 is formed in the inner cover 51 adjacent to the light emitting portion 61, and the air intake passage 526 is formed in the outer cover 52 adjacent to the light receiving portion 62. Accordingly, the air present in the air intake passages 516 and 526 is sucked by the vacuum source 90 and the outside air is taken into the air intake passages 516 and 526. Accordingly, the outside air flows in the air intake passages 516 and 526 in such a manner that the outside air passes along the light emitting surface 611 of the light emitting portion 61 and the light receiving surface 621 of the light receiving portion 62 to reach the light outlet 515 opposed to the light emitting portion 61 and the light inlet 525 opposed to the light receiving portion 62. That is, the outside air flowing in the air intake passages 516 and 526 comes into touch with the light emitting surface 611 and the light receiving surface 621, thereby reducing the adhesion of soil to the light emitting surface 611 and the light receiving surface 621. As a result, it is possible to prevent a reduction in detection accuracy for wear or damage of the cutting edge 312.

Further, the spindle purge air discharged from the spindle inserting portion 511 toward the cutting blade 31 is sucked through the spindle purge air suction passage 517 formed in the inner cover 51 by operating the vacuum source 90, thereby suppressing the flow of the spindle purge air toward the cutting blade 31. As a result, it is possible to reduce the possibility that the flow of the cutting fluid L being sucked in the blade accommodating portion 501 of the blade cover 50 toward the discharge opening 521 may be disturbed by the spindle purge air.

While the cutting blade 31 is of the type that the cutting edge 312 is provided on the outer circumferential portion of the hub 311, the cutting blade in the present invention is not limited to such a type. For example, the cutting edge 312 may be radially extended to near the rotating shaft. Further, the forming position of the air intake passage 522 for introducing the outside air to the discharge opening 521 to suppress clogging of the discharge opening 521 with the cutting fluid in the first preferred embodiment is arbitrary and not limited to the position shown.

Further, while the discharge opening 521 in the blade cover 50 is formed in the outer cover 52 according to the first preferred embodiment or in both the outer cover 52 and the inner cover 51 according to the second preferred embodiment, the discharge opening 521 may be formed in the inner cover 51. Further, the forming position of the discharge opening 521 is not limited to the top surface of the blade cover 50, but any suitable position may be selected. For example, the discharge opening 521 may be formed on the side surface of the outer cover 52 on the leading side in the feeding direction of the workpiece 1, i.e. on the X1 side as viewed in FIG. 1. In this case, the cutting fluid containing the cut dust can be sucked at a smaller suction rate as compared with the case that the discharge opening 521 is formed on the top surface of the blade cover 50.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A cutting apparatus comprising:

holding means for holding a workpiece;

a cutting blade for cutting said workpiece held by said holding means;

a spindle unit including a spindle for rotatably supporting said cutting blade;

a blade cover mounted on said spindle unit for covering said cutting blade, said blade cover having a bottom portion formed with an opening from which the lower end of said cutting blade projects; and cutting fluid supplying means for supplying a cutting fluid to the upper surface of said workpiece in the periphery of said opening of said blade cover;

said blade cover having a blade accommodating portion as an inside space for accommodating said cutting blade, said blade cover being formed with a discharge opening communicating with said blade accommodating portion and connected to a vacuum source;

whereby said cutting fluid supplied to the upper surface of said workpiece is taken from said opening into said blade accommodating portion of said blade cover in association with the rotation of said cutting blade and thereafter discharged from said discharge opening to the outside of said blade cover, wherein said cutting blade has a cutting edge formed along an outer circumference;

said blade cover is provided with blade detecting means including a light emitting portion and a light receiving portion opposed to each other;

said blade cover has a first insertion hole for allowing the insertion of said light emitting portion and a second insertion hole for allowing the insertion of said light receiving portion, said light emitting portion and said light receiving portion being respectively inserted in said first insertion hole and said second insertion hole with said cutting edge interposed therebetween;

a side wall of said first insertion hole is formed with a light outlet opening to said blade accommodating portion for allowing the emergence of detection light emitted from said light emitting portion toward said light receiving portion;

a side wall of said second insertion hole is formed with a light inlet opening to said blade accommodating portion for allowing the entrance of said detection light emitted from said light emitting portion toward said light receiving portion;

said blade cover is formed with a first air intake passage having one end opening to the outside of said blade cover and the other end communicating with said light outlet, said light emitting portion having a light emitting surface exposed to said first air intake passage; and said blade cover is further formed with a second air intake passage having one end opening to the outside of said blade cover and the other end communicating with said light inlet, said light receiving portion having a light receiving surface exposed to said second air intake passage.

2. A cutting apparatus comprising:

holding means for holding a workpiece;

a cutting blade for cutting said workpiece held by said holding means;

a spindle unit including a spindle for rotatably supporting said cutting blade;

a blade cover mounted on said spindle unit for covering said cutting blade, said blade cover having a bottom portion formed with an opening from which the lower end of said cutting blade projects; and cutting fluid supplying means for supplying a cutting fluid to the upper surface of said workpiece in the periphery of said opening of said blade cover;

said blade cover having a blade accommodating portion as an inside space for accommodating said cutting blade, said blade cover being formed with a discharge opening communicating with said blade accommodating portion and connected to a vacuum source;

whereby said cutting fluid supplied to the upper surface of said workpiece is taken from said opening into said blade accommodating portion of said blade cover in association with the rotation of said cutting blade and thereafter discharged from said discharge opening to the outside of said blade cover, said spindle unit includes an air spindle unit such that said spindle is supported by an air bearing; and said blade cover has a spindle inserting portion for allowing the insertion of said spindle and a spindle purge air suction passage having one end connected to said spindle inserting portion and the other end connected to said vacuum source, whereby pressure air discharged from said spindle inserting portion toward said cutting blade is sucked through said spindle purge air suction passage.

* * * * *